United States Patent [19]

Hayashi

[11] Patent Number: 4,459,967

[45] Date of Patent: Jul. 17, 1984

[54] IGNITION COIL FOR INTERNAL COMBUSTION ENGINES

[75] Inventor: Toshio Hayashi, Okazaki, Japan

[73] Assignee: Nippondenso Co., Ltd., Kariya, Japan

[21] Appl. No.: 304,560

[22] Filed: Sep. 22, 1981

[30] Foreign Application Priority Data

Sep. 24, 1980 [JP] Japan ..... 55-133224
Jul. 14, 1981 [JP] Japan ..... 56-110165

[51] Int. Cl.[3] ..... F02P 3/02

[52] U.S. Cl. ..... 123/634; 336/92; 336/94; 336/182

[58] Field of Search ..... 123/634; 336/90, 92, 336/94, 107, 182, 208

[56] References Cited

U.S. PATENT DOCUMENTS

| | | | |
|---|---|---|---|
| 1,499,931 | 7/1924 | Jacobson | 336/92 |
| 1,657,003 | 1/1928 | Cragg | 123/634 |
| 1,931,619 | 10/1933 | Norviel | 336/107 |
| 2,062,014 | 11/1936 | Piffath | 175/361 |
| 2,449,438 | 9/1948 | Wisegarver | 336/90 |
| 2,483,815 | 10/1949 | Easton | 336/90 |
| 2,642,559 | 6/1953 | Visch | 336/90 |

FOREIGN PATENT DOCUMENTS

| | | | |
|---|---|---|---|
| 915351 | 7/1954 | Fed. Rep. of Germany . | |
| 195689 | 2/1958 | Fed. Rep. of Germany | 336/90 |
| 2422269 | 1/1975 | Fed. Rep. of Germany | 123/634 |
| 988351 | 8/1951 | France . | |
| 107213 | 8/1980 | Japan | 336/90 |
| 752570 | 7/1956 | United Kingdom . | |
| 1184433 | 3/1970 | United Kingdom . | |
| 1360993 | 7/1974 | United Kingdom | 123/634 |

*Primary Examiner*—Parshotam S. Lall
*Assistant Examiner*—W. R. Wolfe
*Attorney, Agent, or Firm*—Cushman, Darby & Cushman

[57] ABSTRACT

An ignition coil for use with internal combustion engines includes a casing made of iron materials and a coil cap made of an insulating material and secured to the opening end of the casing to close the same. The casing contains a central core, a secondary coil disposed about the outer periphery of the central core, and a primary coil disposed around the outer periphery of the secondary coil. The coil cap mounts thereon primary and secondary terminals, and is integrally formed with a cylindrical leg portion shaped to extend toward the inner bottom surface of the casing and enclose the secondary coil inward. The cylindrical leg portion of the coil cap is integrally formed at its outer periphery with upper and lower flanges, and the primary coil is wound round the outer periphery of the cylindrical leg portion between the upper and lower flanges.

8 Claims, 6 Drawing Figures

IGNITION COIL FOR INTERNAL COMBUSTION ENGINES

BACKGROUND OF THE INVENTION

The present invention relates to ignition coils for internal combustion engines, and more particularly, to a coil cap structure in ignition coils of the type having a casing made of steel.

Conventional ignition coils of the prior art are constructed such that a coil is received in the opening end of the casing and secured thereto by pressing the casing around the coil cap so as to seal the casing made of steel after an assembly of windings, core and the like is accommodated in the casing and an insulating oil is filled in the casing, and that for securement of the windings the leg portion of the coil cap extends in insulating relationship with a central core which is at high voltages, and the tip end of the leg portion of the coil cap bits into the end portion of a secondary coil.

With such arrangement of the prior ignition coils, a primary spool serving as a base for a primary coil is needed, and the tip end of the leg portion of the coil cap bites into the end of the secondary coil to hold the same, thereby indirectly holding the primary coil or alternatively the primary spool for the primary coil is securedly held by the flange portion of the coil cap. In such construction, play tends to be produced between the coil cap and the primary coil, thus rendering securement of the windings inadequate when the ignition coil is mounted at locations where violent vibrations act, and it is possible that breaking of wire occur at the connection of the primary coil to the primary terminal due to the heavy primary coil being moved.

SUMMARY OF THE INVENTION

It is an object of the invention to provide an ignition coil which can dispense with a primary spool serving as a base for a primary winding.

It is a further object of the invention to provide an ignition coil in which no other part is interposed between a primary winding and a coil cap to eliminate any play therebetween, thereby providing a good vibration-proof characteristics.

It is still further object of the invention to provide an ignition coil in which positioning and securering of a secondary bobbin having a secondary coil wound therearound can be facilitated and ensured.

According to the invention, there is provided an ignition coil in which a coil cap is provided with a cylindrical leg portion shaped to electrically insulate and enclose a secondary coil and a central core, said cylindrical leg portion having upper and lower flanges on the outer periphery thereof to have a primary coil wound therebetween, said coil cap being constructed in a manner to enable connecting the primary coil to primary terminals disposed at the upper portion of the coil cap, and in which the cylindrical leg portion of the coil cap is formed at its one side surface with a window, as desired, said window permitting the terminal end of the secondary coil to pass therethrough to be connected to the primary coil. The ignition coil includes a secondary bobbin round which the secondary coil in the form of a plurality of segments is wound and which is enclosed by the cylindrical leg portion as the central core is. The small cylindrical portion of the coil cap and the tower portion of the secondary bobbin engage each other with projections and recesses thereon engaged by each other, so that positioning and securement of the secondary bobbin having the secondary coil wound therearound can be facilitated and ensured.

DESCRIPTION OF THE PREFERRED EMBODIMENT

Figure 1:
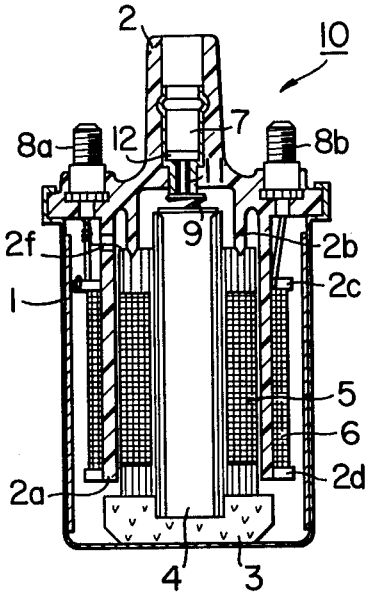
FIG. 1 is a vertical sectional view of an ignition coil according to an embodiment of the invention.
Figure 2:
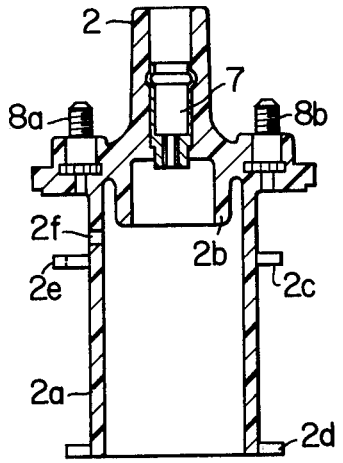
FIG. 2 is a vertical sectional view of a coil cap of the ignition coil of FIG. 1.
Figure 3:
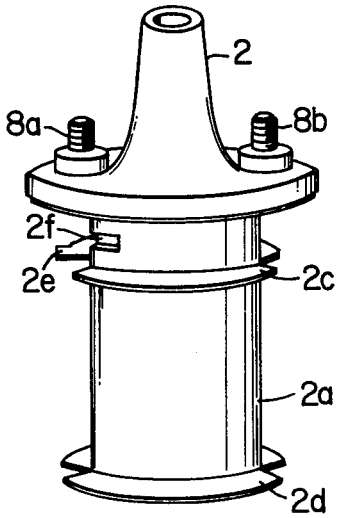
FIG. 3 is a perspective view of the coil cap of FIG. 2.

Referring to FIGS. 1 through 3, there is shown an ignition coil 10 for internal combustion engines, according to an embodiment of the present invention, including a cup-shaped casing 1 made of steel material, a coil cap 2 made of a high pressure-resistant, insulating resin for closing the opening of said casing 1, a base 3 made of porcelain and disposed on the inner bottom surface of said casing 1, and a central core 4 disposed centrally in insulating relation to said casing 1. The coil cap 2 is secured to said casing 1 by pressing the opening edge of the casing 1 around the cap 2. The ignition coil 10 also includes a secondary coil 5 disposed around the periphery of the central core 4, a primary coil 6 disposed around the periphery of the secondary coil 5, a secondary terminal 7 mounted centrally in the coil cap 2, and primary terminals 8a, 8b secured to the coil cap 2. The respective terminal ends of the secondary coil 5 and the primary coil 6 are electrically connected to the primary terminal 8a, and the starting end of the secondary coil 5 is electrically connected to the secondary terminal 7 through said central core 4 and a leaf spring 9. The starting end of the primary terminal 6 is electrically connected to the primary terminal 8b. The secondary terminal 7 is formed with an internally threaded aperture 11 through which an insulating oil is introduced into the casing 1 and into which a machine screw 12 is threaded after the interior of the casing 1 is filled with the insulating oil.

Referring now to FIGS. 2 and 3, the coil cap 2 is constructed in a manner to extend toward the inner bottom surface of the casing 1, and comprises a cylindrical-shaped leg portion 2*a* shaped to insulate and enclose the secondary coil 5 and the central core 4, a small cylindrical portion 2*b* disposed inwardly of said leg portion 2a to extend toward the secondary coil 5 and adapted to bite into the end portion of the secondary coil 5 for securement thereof, and flange portions 2*c* and 2*d* formed integral with the leg portion 2*a* at the outer periphery thereof to accommodate therebetween the primary coil 6. The upper flange portion 2*c* is formed with an integral projection 2*e* which has the terminal end of the primary coil 6 wound therearound. A window 2*f* is provided at the upper portion of the leg portion 2*a* to direct the terminal end of the secondary coil 5 outside of the leg portion 2*a* for connection to the terminal end of the primary coil 6 which in turn is connected to the primary terminal 8*a*.

The ignition coil 10 thus constructed is assembled in the following manner. First, the primary coil 6 is wound around the outer periphery of the cylindrical-shaped leg portion 2*a* between the upper and lower flange portions 2*c* and 2*d*, and the terminal end thereof is wound about the projection 2*e* in several turns and then is connected to the primary terminal 8*a* by soldering. The starting end of the primary coil 6 is also connected to the terminal 8*b* by soldering. The secondary coil 5 having been in advance wound is inserted into the leg portion 2*a* with the terminal end thereof extended outside of the leg portion 2*a* through the window 2*f* for connection to the terminal end of the primary coil 6 by soldering. Thereafter the leaf spring 9 is assembled with the top end of the central core 4 which in turn is inserted into the secondary coil 5 with the leaf spring 9 abutted against the inner end of the secondary terminal 7. In this condition, the starting end of the secondary coil 5 is engaged by the central core 4 to be electrically connected thereto. The central core 4, secondary coil 5 and primary coil 6 are received in the casing 1 with the base 3 located on the opposite side of the central core 4 of secondary coil 5 to the coil cap 2, and in this position the opening end of the casing 1 is pressed around the coil cap 2 to be closed thereby and secure the coil cap 2 thereto. In this condition the tip end of the small cylindrical portion 2*b* of the coil cap 2 bites into the end portion of the secondary coil 5 to secure the same in the casing 1. Then the insulating oil is filled into the casing 1 through the threaded aperture 11 of the secondary terminal 7 which aperture then is threadedly engaged by the machines screw 12.

With the arrangement of the ignition coil 10, the cylindrical leg portion 2*a* of the coil cap 2 is provided at the outer periphery thereof with the upper and lower flange portions 2*c* and 2*d* to enable the primary coil 6 to be directly wound round the coil cap 2, thereby dispensing with any primary spool and providing an ignition coil having a good vibration-proof characteristics. In addition, the secondary coil 5 centering about the central core 4 is received in the cylindrical leg portion 2*a*, which arrangement contributes to insulation of parts of high voltages, thus improving the insulating characteristics of the ignition coil. In the above embodiment, the base 3 is made of porcelain, but may be made of a high pressure-resistant, insulating resin to fit on the lower end of the cylindrical leg portion 2*a*. Also the window 2f can be dispensed with by changing the manner of taking out the terminal end of the secondary coil 5.

Figure 4:
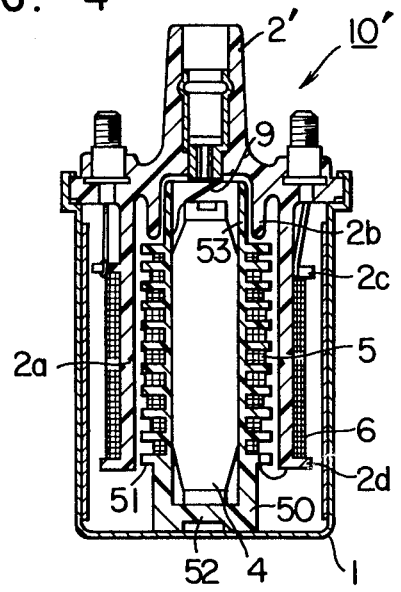
FIG. 4 is a vertical sectional view of an ignition coil according to another embodiment of the invention.
Figure 5:
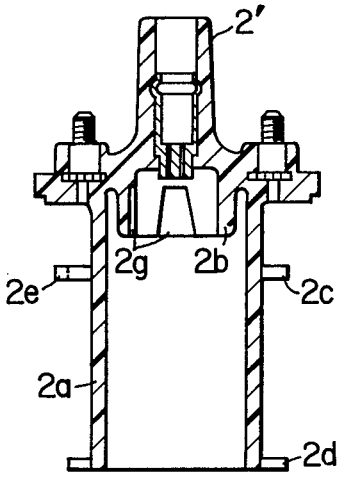
FIG. 5 is a vertical sectional view of a coil cap of the ignition coil of FIG. 4.
Figure 6:
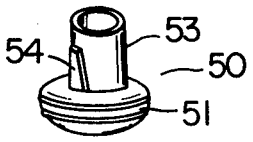
FIG. 6 is a fragmentary perspective view of a secondary bobbin of the ignition coil of FIG. 4.

Referring now to FIGS. 4 through 6, there is shown an ignition coil 10' according to a further embodiment of the present invention. In the drawings, parts similar to those of the embodiment shown in FIGS. 1 through 3 are designated by the same numerals. In FIGS. 4 and 5, a bobbin 50 is provided at its outer periphery with a plurality of winding grooves 51 and at its lower end with a closure portion 52. The bobbin 50 is made of a high pressure-resistant, insulating resin and is adapted to be disposed in the casing 1 with the closure portion 52 resting on the inner bottom surface of the casing 1. The central core 4 is inserted in the bobbin 50 to insulated by means of the closure portion 52 from and disposed centrally in the casing 1. The secondary coil 5 is divided into a plurality of sections, each of which is received in the respective winding grooves 51. The small cylindrical portion 2*b* of the coil cap 2' is fitted around the outer periphery of a tower portion 53 of the secondary bobbin 50 to securedly mount the bobbin in the casing 1. In addition, the small cylindrical portion 2*b* of the coil cap 2' is internally formed with axially extending recesses 2*g*, of which width diverges downwardly. As shown in FIG. 6, the tower portion 53 of the secondary bobbin 50 is formed at its outer periphery with axially extending projections 54, each of which is of a shape corresponding to that of the recess 2g. The recesses 2*g* or projections 54 are two in number, but may be three or more in number.

In assembling the ignition coil 10' according to the second embodiment of the present invention, the secondary coil 5 is in advance wound round the secondary bobbin 50. After the leaf spring 9 is mounted on the top of the central core 4, the central core 4 is inserted into the secondary bobbin 50 with the starting end of the secondary coil 5 interposed between the leaf spring 9 and the central core 4. Thereafter the tower portion 53 of the secondary bobbin 50 is fitted on the small cylindrical portion 2b with the projections 54 of the tower portion 53 engaged by the recesses 2*g* of the small cylindrical portion 2*b*, and the terminal end of the secondary coil 5 is directed outside of the cylindrical leg portion 2*a* to be connected to the terminal end of the primary coil 6 by soldering. In this condition, the leaf spring 9 abuts against the inner end of the secondary terminal 7, and the starting end of the secondary coil 5 is electrically connected to the secondary terminal 7 through the leaf spring 9. In addition, the closure portion 52 of the secondary bobbin 50 abuts against the inner bottom surface of the casing 1 to thereby securedly mount the secondary coil 5 in the casing 1.

With the arrangement of the ignition coil 10' according to the second embodiment, the secondary bobbin 50 centering about the central core 4 and having the secondary coil 5 wound therearound is enclosed by the cylindrical leg portion 2*a* of the coil cap 2' with the result that the insulating characteristics of the ignition coil can be improved. In FIGS. 5 and 6, the recesses 2g are provided on the inner peripheral surface of the small cylindrical portion 2*b* of the coil cap 2', and the projections 54 are provided on the outer peripheral surface of the tower portion 53 of the bobbin 50. Alternatively, the recesses 2*g* and the projections 54 may be provided on the outer peripheral surface of the tower portion 53 and on the inner peripheral surface of the small cylindrical portion 2b, respectively. Also, according to the above embodiment, the small cylindrical portion 2*b* of the coil cap 2' is fitted on the tower portion 53 of the secondary bobbin 50. Alternatively, the small cylindrical portion 2*b* may be fitted in the tower portion 53 of the secondary bobbin 50 by reversing the relative sizes thereof.

Obviously, many modifications and variations are possible in light of the above disclosure. Thus, it is to be understood that, within the scope of the appended claims, the invention may be practiced otherwise and as specifically described.

What is claime is:

1. An ignition coil for internal combustion engines, said ignition coil comprising:

a casing made of iron;

a coil cap made of a high pressure-resistant insulating resin and secured to said casing to close the open end thereof;

a central core contained in said casing;

a secondary coil disposed around said central core and contained in said casing;

a primary coil disposed around said secondary coil and contained in said casing;

primary and secondary terminals secured to said coil cap;

a high pressure-resistant, insulating body interposed between said central core and the inner bottom surface of said casing;

an insulating oil filled in said casing; and a spring intervening between said central core and said secondary terminal to bias said central core against said high pressure-resistant, insulating body;

said coil cap including a cylindrical-shaped leg portion shaped to extend toward the bottom surface of said casing and enclose said secondary coil, a small cylindrical portion disposed inwardly of said leg portion to extend toward said secondary coil within said cylindrical-shaped leg portion and to securedly press said second coil toward the inner bottom surface of said casing through the medium of said high pressure-resistant, insulating body, and flange portions integrally provided on the upper and lower peripheral ends of said cylindrical-shaped leg portion, said primary coil being wound round the periphery of said cylindrical-shaped leg portion between said flange portions, the end of said cylindrical-shaped leg portion facing both the inner bottom surface of said casing and said insulating body with gaps therebetween, and the inner peripheral surface of said cylindrical-shaped leg portion cooperating with said secondary coil to define a further gap therebetween, so that the inner and outer peripheral surfaces of said cylindrical-shaped leg portion are communicated to each other through said respective gaps.

2. An ignition coil as set forth in claim 1 wherein said upper flange on cylindrical leg portion is integrally formed with a projection, on which the winding end of said primary coil is wound in several turns.

3. An ignition coil as set forth in claim 1 wherein has a tip end said small cylindrical portion is adapted to bite into the end portion of said secondary coil for rigid securement of said secondary coil in said casing.

4. An ignition coil as set forth in claim 1 wherein said coil cap is formed with a threaded aperture for introduction of an oil, and there is provided a screw adapted to be threaded into said aperture.

5. An ignition coil for internal combustion engines, said ignition coil comprising:

a casing made of iron;

a coil cap made of a high pressure-resistant insulating resin, having an open end and secured to said casing to close the open end thereof;

a secondary hollow bobbin made of a high pressure-resistant, insulating resin and contained in said casing, said secondary bobbin having an open end, a plurality of winding grooves at the outer periphery thereof and a closure portion provided on the side of the bottom surface of said casing to contact the bottom surface;

a central core inserted into said secondary bobbin;

a secondary coil wound in the respective winding grooves of said secondary bobbin in part-winding manner;

a primary coil disposed around the periphery of said secondary coil and contained in said casing;

primary and secondary terminals secured to said coil cap;

an insulating oil filled in said casing; and a spring intervening between said central core and said secondary terminal to bias said central core against the closure portion of said secondary bobbin;

said coil cap including a cylindrical-shaped leg portion shaped to extend toward the bottom surface of said casing and enclose said secondary coil, flange portions provided on the upper and lower peripheral ends of said cylindrical-shaped leg portion and a small cylindrical portion extending toward said secondary bobbin within said cylindrical-shaped leg portion and adapted to be fitted on the open end of said secondary bobbin to securedly press the closure portion of said secondary bobbin against the inner bottom surface of said casing, said cylindrical-shaped leg portion, said flange portions and said small cylindrical portion being formed integral with said coil cap, said primary coil being wound round the periphery of said cylindrical-shaped leg portion between said flange portions, the end of said cylindrical-shaped leg portion facing the inner bottom surface of said casing with a cap therebetween.

6. An ignition coil as set forth in claim 5 wherein said coil cap is formed with a threaded aperture for introduction of an oil, and there is provided a screw adapted to be threaded into said aperture.

7. An ignition coil as set forth in claim 5 wherein one of the open end portion of said secondary bobbin and the small cylindrical portion of said coil cap is formed with an axially extending recess and the other of the open end portion of said secondary bobbin and the small cylindrical portion of said coil cap is formed with an axially extending projection which is adapted to mate with said recess.

8. an ignition coil as set forth in claim 7 wherein said recess has an axial tip end which is wide and said projection has an axial tip end which is narrow.

* * * * *